US011104403B2

(12) United States Patent
Van Newhouse et al.

(10) Patent No.: US 11,104,403 B2
(45) Date of Patent: Aug. 31, 2021

(54) BOAT SHADE SYSTEM

(71) Applicant: Atlantic Coast Canvas Company, Lexington, SC (US)

(72) Inventors: Timothy Van Newhouse, Chapin, SC (US); Deborah Van Newhouse, Chapin, SC (US); Stephen W. Lowder, West Columbia, SC (US)

(73) Assignee: Atlantic Coast Canvas Company, Lexington, SC (US)

( * ) Notice: Subject to any disclaimer, the term of this patent is extended or adjusted under 35 U.S.C. 154(b) by 0 days.

(21) Appl. No.: 15/930,032

(22) Filed: May 12, 2020

(65) Prior Publication Data

US 2020/0361568 A1 Nov. 19, 2020

Related U.S. Application Data

(60) Provisional application No. 62/848,890, filed on May 16, 2019.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361, 364
See application file for complete search history.

(56) References Cited

U.S. PATENT DOCUMENTS 2,634,740 A 4/1953 Duke
2,714,387 A 8/1955 Meldrum
3,032,046 A 5/1962 Coonradt
5,579,797 A 12/1996 Rogers
6,308,653 B1 10/2001 Geraci
8,393,343 B2 3/2013 Vanvonderen
9,194,152 B1 * 11/2015 Plasencia ..... B63B 17/02
(Continued)

FOREIGN PATENT DOCUMENTS

DE 2348796 A1 4/1975
DE 19702169 A1 7/1998
(Continued)

OTHER PUBLICATIONS

Hendricks, Jim, Installing a Canvas Bow Shade Aboard Your Ship, Boating Magazine, May 18, 2020, https://www.boatingmag.com/story/how-to/installing-a-canvas-bow-shade-aboard-your-boat/.
(Continued)

*Primary Examiner* — Lars A Olson
(74) *Attorney, Agent, or Firm* — Haynsworth Sinkler Boyd, P.A.

(57) ABSTRACT

An adjustable shade system for adding a shade to a boat includes a pair of adjustable shade supports, each of the pair of adjustable shade supports having a base configured to be securely installed in the gimbal connection of a rod holder, the base comprising a groove configured to connect to the gimbal connection of the rod holder and an outer diameter that is configured to fit tightly within a conventional rod holder. A rod extends from the base, and an adjuster having a connector is adjustably connected to the rod to allow vertical adjustment along a length of rod. A shade is connectable to the connectors of the pair of adjustable shade supports and also connectable to a structure of the boat or one or more additional adjustable shade support.

20 Claims, 2 Drawing Sheets

(56) References Cited

U.S. PATENT DOCUMENTS

| | | | |
|---|---|---|---|
| 2008/0202406 | A1 | 8/2008 | del Valle Bravo et al. |
| 2010/0037811 | A1 | 2/2010 | Grant |
| 2018/0072385 | A1 | 3/2018 | Tung |
| 2019/0242153 | A1 | 8/2019 | Mackarvich |

FOREIGN PATENT DOCUMENTS

| | | | |
|---|---|---|---|
| WO | 2019022693 | A1 | 1/2019 |
| WO | 2019070555 | A1 | 4/2019 |

OTHER PUBLICATIONS

Oceansouth, Ocean South Bimini Extension Airflow Boat Shades, Amazon, https://www.amazon.com/Oceansouth-Bimini-Extension-Airflow-Shades/dp/B07NPPP25L/ref=sr_1_2?dchild=1&keywords=boat+shades&qid=1587734040&rnid=2941120011&s=sports-and-fitness&sr=1-2&th=1.

* cited by examiner

BOAT SHADE SYSTEM

REFERENCE TO RELATED APPLICATION

This application claims priority to U.S. Provisional Patent Application No. 62/848,890 filed on May 16, 2019, the entire contents of such application being incorporated herein by reference.

BACKGROUND

It can get very hot on the deck (i.e. the surface on which people stand, sit or lay down when on a boat other than a protected compartment, like a head or a cabin) of a boat (typically a recreational marine vessel), especially in summer. To beat the heat (as well as the rain, and other conditions), boat manufacturers and others in the boating industry have come up with a wide variety of ways to provide cover to people who are on the deck of a boat. However, all of the current options have their drawbacks and/or limitations.

Bimini tops provide a little more shade than a t-top, but still do not cover the entire deck of a boat and are not typically used on larger boats (i.e. larger than about 20 feet in length). T-tops provide shade to a boat, typically over and around the center console of a boat, but leave a large portion of the deck completely uncovered. T-tops can be made bigger to provide more shade, but they cannot be made large enough to cover the entire deck and, if too large, may get in the way when, for instance, people are fishing from the boat. Further, t-tops are set at a specific height, which may further limit the shade provided by the t-top when the sun is not directly overhead. Existing shade extensions exist, but they are generally flimsy and can be difficult to install and/or require additional support (i.e. straps, etc.). What is needed is a quick, secure, reliable way to provide shade, or additional shade, to the deck of a boat in a way that allows a user to determine where the shade is placed, to adjust the height of the shade, to adjust the amount of shade, and that is strong enough to withstand wind or other conditions without breaking or requiring time-consuming additional support mechanisms.

SUMMARY

According to an implementation described herein, an adjustable shade system for adding a shade to a boat includes a pair of adjustable shade supports, each of the pair of adjustable shade supports having a base configured to be securely installed in the gimbal connection of a rod holder. The base includes a groove configured to connect to the gimbal connection of the rod holder and an outer diameter that is configured to fit tightly within a conventional rod holder. A rod extends from the base, and an adjuster having a connector is adjustably connected to the rod to allow the adjuster to be vertically adjusted along a length of rod. A shade is connectable to the connectors of the pair of adjustable shade supports and also connectable to a structure of the boat or an additional adjustable shade support. The groove may include a width at a bottom end of the base, the width being smaller than the diameter of a gimbal pin that is used in a conventional rod holder. The groove being configured to lock the adjustable shade support in the gimbal connection of the rod holder. The base may extend for a length of from about 2 inches to about 10 inches and have a uniform cross sectional area along the length. The length may be about six inches. The outer diameter may be from about 1.5 inches to about 1.56 inches. The rod may have a diameter that is smaller than the outer diameter of the base. The rod may include a stop. The rod may further include a handle. The adjuster may include a retainer configured to set the position of the adjuster on the rod. The adjuster may be configured to rotate around the rod. The base may include a recess opposite the groove, and the rod may extend from the recess. The rod may include a cap opposite the base.

According to another implementation described herein, an adjustable shade support includes a base configured to be securely installed in a rod holder, the base having a groove configured to connect to the gimbal pin of the rod holder. The base includes an outer diameter that is configured to fit tightly within a conventional rod holder. A rod extends from the base, and an adjuster that includes a connector is adjustably connected to the rod such that the position of adjuster can be adjusted along a length of rod. The groove may include a width at a bottom end of the base and a circular cross section opposite the width, the width being smaller than the diameter of the gimbal pin that is used in a conventional rod holder, the groove being configured to lock the adjustable shade support in the rod holder. The width may be about 0.240 inches and the circular cross section may include a diameter of about 0.250 inches. The base may extend for a length of about six inches. The base may include an outer diameter of about 1.53 inches. The rod may have a smaller diameter than the base. The base may include a recess in which the rod is positioned to connect the rod to the base. The adjuster may be vertically and rotationally adjustable along the length of the rod and where the length may be the distance between a handle and a stop, the base and the stop, or the handle and an end of the rod, the end being on the rod opposite the base.

DETAILED DESCRIPTION

FIGS. 1A through 2B are attached hereto and incorporated herein by reference. The following detailed description refers to the accompanying FIGS. 1A through 2B. The same reference numbers in different figures may identify the same or similar elements.

The systems, methods, technologies and/or techniques (hereinafter, the "systems and methods"), described herein, may include an adjustable shade system that may provide a shade (i.e. a canvas shade, a tarp, a solid shade, etc.) to protect the deck of a boat from the environment (e.g. sun, rain, etc.). The adjustable shade system may provide the shade using one or more adjustable shade supports, which connect to the shade to secure the shade to the boat and/or structure connected to the boat. The shade may be supported by structure extending from the boat, like a t-top, one or more adjustable shade supports, or an alternative shade support. Additionally, or alternatively, the shade may be supported exclusively by adjustable shade supports. The adjustable shade supports may have a base at a first end that connects with the vessel to secure the shade. The base may connect with a rod holder, a gunnel, a rail or any other structure of a boat. In one embodiment, the base includes a gimbal end that allows the first end to "lock" into a rod holder, such as a flush mount rod holder that is typically installed on the gunnel of a boat. The adjustable shade support may have a second end that may include an adjustable connector that connects with the shade to secure the shade to the adjustable shade support. The adjustable connector may be adjustable along a length of the adjustable shade support between the second end and base or second end and some other portion of adjustable shade support (e.g. a stop, a handle, etc.), which may adjust the height of the shade.

Figure 1A:
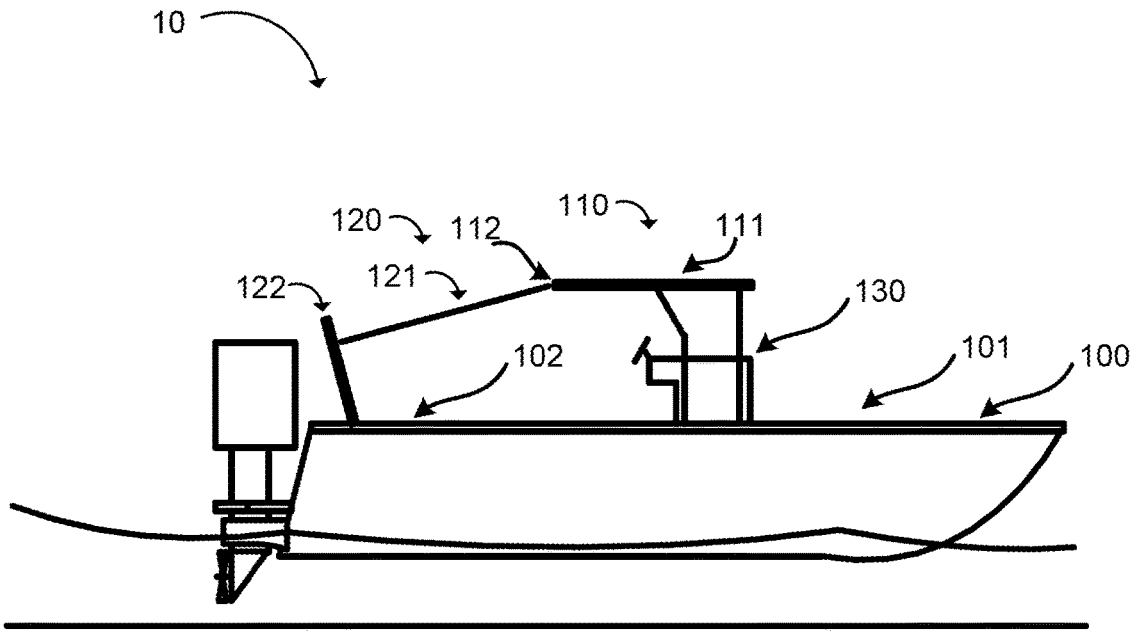
FIGS. 1A through 1C illustrate non-limiting example environments in which the systems and/or methods described herein may be implemented.
Figure 1B:
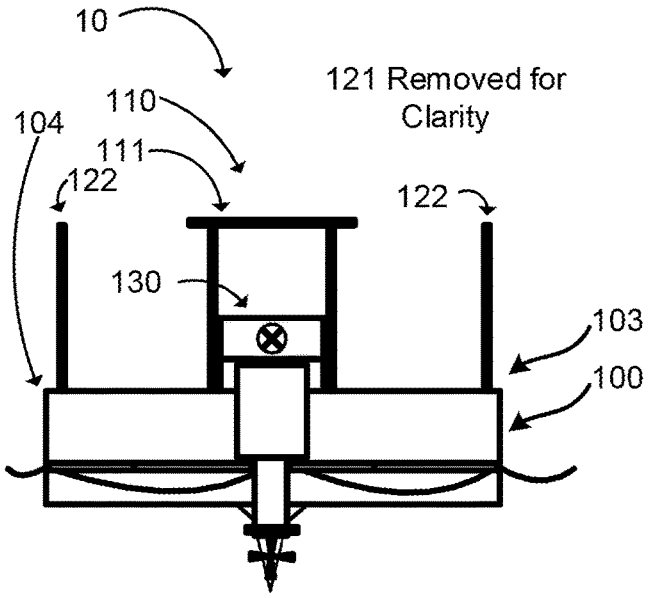
Figure 1C:
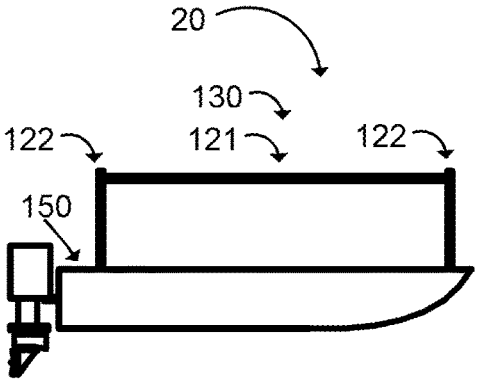

FIGS. 1A through 1C illustrate two non-limiting example environments in which the systems and/or methods described herein may be implemented. Environment 10 depicted in FIGS. 1A and 1B includes a boat 100 that includes a t-top 110 having a top 111, an adjustable shade system 120 having a shade 121 and adjustable shade supports 122, and a center console located under the t-top 120. Environment 20 depicted in FIG. 1C may include a boat 150 having an adjustable shade system 130 that includes a shade 121 and adjustable shade supports 122. The shades, structures, and components described in relation to FIGS. 1A through 1C are provided for explanatory purposes only, and the disclosure herein is not intended to be limited to environments 10 & 20 reflected in FIGS. 1A through 1C. There may additional components, fewer components and/or differently arranged components than what is shown in FIGS. 1A through 1C. Also, in other implementations, one or more of the components of FIGS. 1A through 1C may perform the function of one or more other components of FIGS. 1A through 1C.

In the environment 10 depicted in FIGS. 1A and 1B, boat 100 may be a center console boat that includes a center console 130. The center console 130 may include one or more components (i.e. steering wheel, throttle, electronics, etc.) from which the boat may be controlled. A t-top 110 may include a top 111, which may provide cover to the deck of the boat in the area approximately under the top 111. However, t-top 110 is only an example of the structure that may be used to support one end shade 121. Many other structures typically found on boats may be used to support one end of shade 121, while a pair of adjustable shade supports 122 support the other end of shade 121. Typical examples of boat structure that may be used to support one end of shade 121 include a center console, dual console, bimini top, hard top, a windshield, alternative shade support poles and rods, etc. Any structure on a boat may be used, but, ideally, structure that is over the head of the users of the boat is best, as that prevents the users from having to duck to get under the shade and/or allows users to more comfortably use the shade provided.

A large portion of the deck, such as the front deck 101 and the stern deck 102, may receive little or no cover from top 111. An adjustable shade support system 120 may include shade 121 situated over the stern deck 102 of the boat 100. In other embodiments, adjustable shade support system 120 may be situated over the bow deck (i.e. in front of the t-top, etc.) or another portion of the boat. The adjustable support system 120 may further include adjustable shade supports 122 that connect to (i.e. using snaps, hooks, buttons, rope, cord, etc.) shade 121. Shade 121 may also be connected to top 111 at the stern end 112 of top 111 using the same or similar connections used to connect shade 121 to adjustable shade supports 122. In this way, shade 121 is connectable to adjustable shade supports 122 and/or structure of the boat to provide cover to the stern deck 102 of the boat. The shade may protect passengers on the boat from the sun, precipitation, wind and/or a combination of the foregoing.

As shown in FIG. 1B, a pair of adjustable support shades 122 may be connected to the gunnels of the boat 100. For instance, the adjustable support shades 122 may be connected to the gunnels of the boat 100 at a pair of rod holders (i.e. flush mounted rod holders, etc.), which are common on center console boats. The rod holders may include a gimbal connection in which one or more gimbal pins located at or near the bottom of the rod holder may interlock (i.e. fit partially within) a corresponding groove or grooves located in an end of adjustable shade support 122, which may "lock" the adjustable shade support 122 into the rod holder (i.e. similar to the way that a fishing rod, a downrigger, etc., may be locked into a rod holder). "Locking" into the rod holders in this way may limit and/or prevent the adjustable shade supports from twisting and/or allow the adjustable shade supports to support shade 121 in a variety of conditions, such as when the boat is moving through the water, when the wind is blowing, when the boat is being towed by a car on the highway, etc. (even if adjustable shade support system 120 is not strong enough to withstand the conditions). In some instances, locking the adjustable shade support 122 in place makes it difficult to extract the adjustable shade support 122 from the rod holder, which provides additional support and strength to the installation. Because the adjustable shade supports 122 are positioned on the starboard gunnel 103 and port gunnel 104 of the boat 100, the shade 121 (not shown) may extend across the beam of the boat when the shade 121 connects to each of the adjustable shade supports 122. The shade may connect to the stern end 112 of top 111 on one side of the shade 121 and to adjustable shade supports 122 on an opposite side of shade 121 to provide cover to the stern deck 102 of the vessel. In other embodiments, the adjustable shade supports 122 may be placed in other areas, such as rod holders on the bow of the boat, which may provide shade 121 to the front deck 101 of the boat 100 when the shade is connected to the adjustable shade supports 122 and t-top (for instance, the bow end oft-top) or to additional adjustable shade supports 122 or other structure of the boat. The total length of adjustable shade supports may vary but must be enough to place the shade high enough to keep it out of the way. In some embodiments, the ideal length of adjustable shade supports ranges from about 4 feet to about 10 feet. In one embodiment, the adjustable shade support is about 6 feet long. Adjustable shade supports may be moved to many different areas of a boat to provide shade to different areas of the deck of a boat. Additionally, or alternatively, the adjustable shade supports may be used in many different applications other than boats, such as recreational vehicles, porches, patios, etc.

As will be further discussed with reference to FIG. 2, adjustable shade supports 122 may connect to the shade 121 using a connector. The connector may be adjustable along a length of the adjustable shade support 122 and around the rod of the adjustable shade support 122, which may allow the users of the boat to adjust the point at which the shade 121 connects to the adjustable shade support 122, which allows adjustment of the height of the shade 121 (i.e. to provide more coverage during times when the sun is at an angle, to move shade 121 out of the way when fishing, etc.), rotation of the shade, etc.

FIG. 1C shows an alternative environment in which the adjustable shade system 130 may be connected to a boat 150. Instead of connecting to a t-top, adjustable shade system 130 may provide shade 121 to the deck of boat 150 using only adjustable shade supports 122. In this embodiment, four adjustable shade supports 122 connect to shade 121 to provide shade to the deck of the boat 150. This embodiment may be useful when a boat does not have other structure (i.e. a t-top, a bimini top, a windshield, a console, a cabin, outriggers, rod holders connected to t-tops, etc.) that can be used to connect to shade 121. The example environments depicted in FIGS. 1A through 1C are for example only, and the adjustable shade system may be connected to boats in a variety of ways to provide shade to the deck of a boat.

Figure 2A:
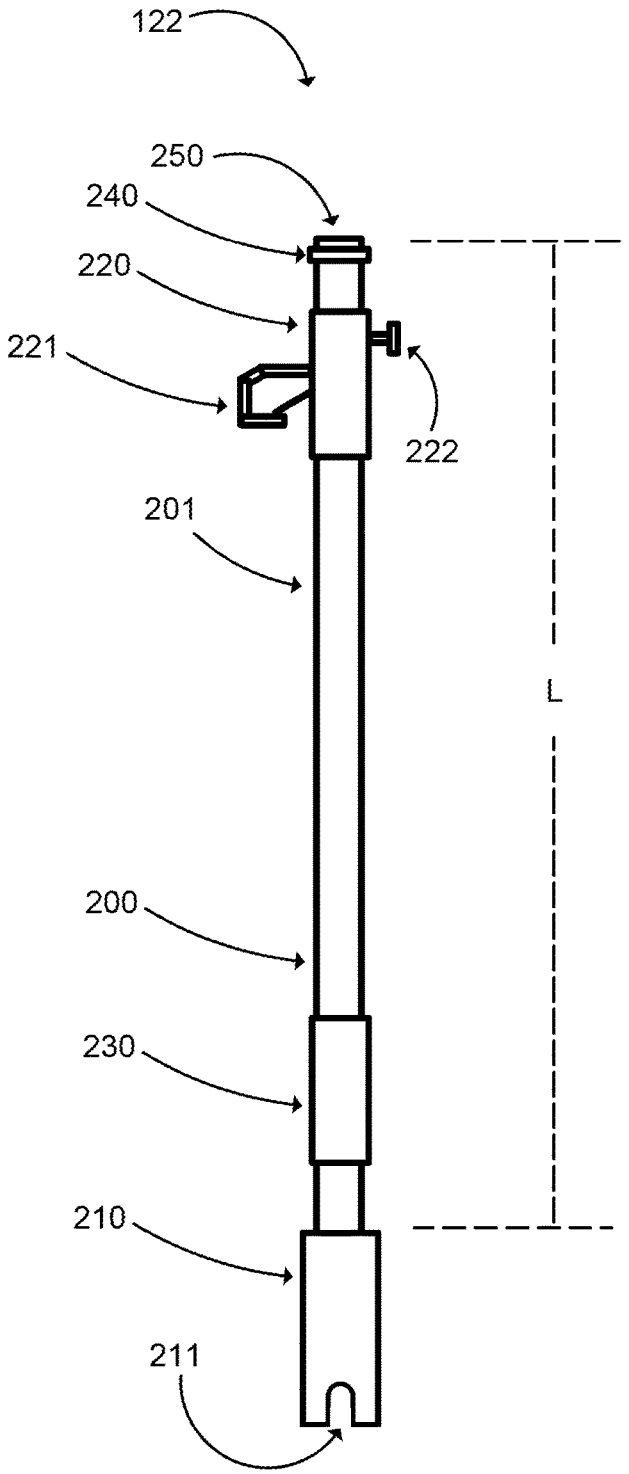
FIG. 2A provides an example embodiment of the adjustable shade support provided in connection with the environments of FIGS. 1A through 1C.

FIG. 2A illustrates an example embodiment of the adjustable shade support 122 of FIGS. 1A through 1C. As shown in FIG. 2A, adjustable shade support 122 may include a rod 201, a base 210, an adjuster 220 and a handle 230. The components described in relation to FIG. 2A are provided for explanatory purposes only, and the disclosure herein is not intended to be limited to the exact components, or arrangements of components, reflected in FIG. 2A. There may additional components, fewer components and/or differently arranged components than what is shown in FIG. 2A. Also, in other implementations, one or more of the components of FIG. 2A may perform the function of one or more other components of FIG. 2A.

Rod 201 may be a shaft, a bar, a rod, etc. that provides a length L for adjustment of a position of connector 221, which may be used to install a shade as described herein. Rod 201 may be formed from one or more materials (e.g., a metal alloy, like stainless steel, composite, polymer, wood, ceramic, fiberglass, etc.) of sufficient strength and rigidity to support the tension created by a shade when it is installed on a vessel as well as the static and/or dynamic loads (e.g., forces, torques, tensions, compressions, stresses, strains, etc.) imparted on rod 201 by, for instance, wind, when the boat is moving, installing the adjustable shade support 122, and/or any additional forces transferred to the rod 201. In one embodiment, rod 201 is formed from a hollow stainless member having a round cross section, a diameter of about ⅞ inches and a wall thickness of about 0.049 inches, or at least 0.035 inches, which may provide rigidity. In another embodiment, rod 201 is an extension of base 210 and formed from the same material as base 210. Rod 201 may also, or alternatively, be formed from a material (e.g., stainless steel, polymer, composite, ceramic, fiberglass, etc.) of sufficient corrosion resistance and toughness to withstand exposure to water, air, saltwater, cleaning solvents, etc. as well as abrasive materials. (e.g. shells, sand, grit etc.). Rod 201 may be composed of one or more pieces. The types and shapes of rod 201 are not intended to be limited to those shown in FIG. 2A. Rod 201 may have a circular cross section, as depicted in FIG. 2A, or may have another cross section (e.g. square, rectangle, octagon, I-Beam, etc.). In many embodiments, rod 201 has a circular cross section, which permits adjuster 220 to easily rotate around rod 201. Rod 201 may have a first end and a second end opposite the first end. Rod 201 may be connected to base 210 at the first end and to a cap 250 at the second end. Cap 250 may close a hollow end of rod 201, which may prevent rain, water, dirt, etc. from entering rod 201.

Figure 2B:
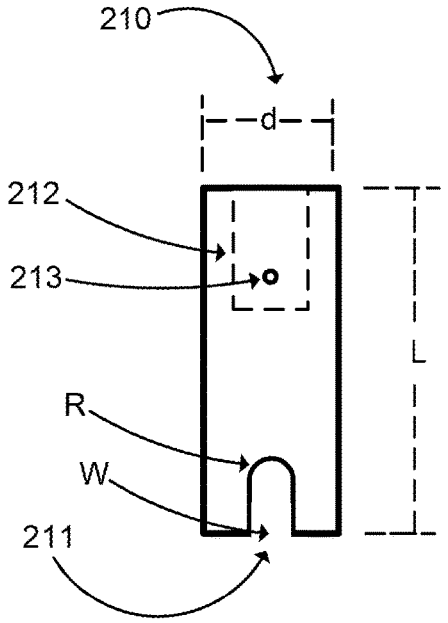
FIG. 2B illustrates the base used in connection with the adjustable shade support of FIG. 2A.

Base 210 may be the section of adjustable shade support 122 that is used to connect adjustable shade support 122 to a boat. Base 210 may include clamps, screws, etc. that are used to connect adjustable shade support 122 to a boat. In the embodiment depicted in FIG. 2, base 210 includes a groove 211 (i.e. one or more grooves), which corresponds to a cavity in base 210 that connects with a gimbal connection in, for example, a fishing rod holder, which connects adjustable shade support 122 to a boat as discussed above with reference to FIGS. 1A through 1C. Base 210 may be formed as a part of rod 201 and/or may be a separate piece of material that is connected to (e.g. welded, riveted, fastened, etc.) rod 201. Base 210 may be formed from one or more materials (e.g., a metal alloy, like stainless steel, composite, polymer, wood, ceramic, fiberglass, etc.) of sufficient strength and rigidity to support the loads imparted on base 210 by a shade when it is installed on a boat as well as the static and/or dynamic loads (e.g., forces, torques, tensions, compressions, stresses, strains, etc.) imparted on base 210 by, for instance, wind, when the boat is moving, installing the adjustable shade support 122 (i.e. pressing the base 210 into the gimbal connector, including when locking it in, as further described herein), and/or any additional forces transferred to the base 210 from the rod 201, the rod holder, a user, etc. In one embodiment, base 210 is formed from a synthetic (e.g. plastics such as nylon, hdpe, etc.) member having a round cross section which may be easily machined to the dimensions needed to connect to rod (i.e. the appropriate recess, aperture for a roll pin, etc.) and to provide a groove that locks in place with a gimbal pin, as further described herein. Further, such materials may elastically deform in order for the gimbal pin to be locked into place within base 210. Base 210 may also, or alternatively, be formed from a material (e.g., stainless steel, polymer, composite, ceramic, fiberglass, etc.) of sufficient corrosion resistance and toughness to withstand exposure to water, air, saltwater, cleaning solvents, etc. as well as abrasive materials (e.g. shells, sand, grit etc.). Base 210 may be composed of one or more pieces. The types and shapes of base 210 are not intended to be limited to those shown in FIGS. 2A and 2B. Base 210 may have a circular cross section, as depicted in FIGS. 2A and 2B, or may have another cross section (e.g. square, rectangle, octagon, etc.). In many embodiments, base 210 has a circular cross section, permits base 210 to occupy a majority of the inner cavity of a rod holder, which may allow rod holder to provide support to base 210 (i.e. to keep it from bending, etc.). While base 210 is depicted as having a larger diameter than rod 201, in reality, rod 201 and base 210 may be the same diameter and may be formed from the same piece of material.

In the embodiment depicted in FIGS. 2A and 2B, base 210 is configured to be installed in a rod holder. In this embodiment, base 210 has a generally round cross section having a diameter d that is about the same, or slightly smaller than, the inner diameter of a conventional rod holder such that base 210 is configured to fit tightly within the inner diameter of the rod holder. For example, diameter d may be configured to consume most of the inner diameter of the rod holder, which, for conventional rod holders means diameter d is about 1.25-1.625 inches, more ideally about 1.5-1.56 inches, more ideally about 1.53 inches ("about" means within 2% of total dimension). When diameter d is configured to consume most of the inner diameter of a rod holder, adjustable shade support 122 is restricted from bending or tilting in the rod holder when installed in the rod holder because there is little room for base 210 to tilt or bend within the rod holder. This provides a more stable connection to the rod holder. Further, the groove 211 may be configured to "lock in" to place with a standard gimbal pin. A standard gimbal pin is about 0.250 inches, groove 211 may include an having a generally circular cross section having a radius R in a generally circular cross sectional area where the gimbal pin is to be located when the adjustable shade support is installed in rod holder. The radius is about 0.125" (i.e. a 0.250 diameter cross section), while the groove is tapered to a width W at the end of base 210 opposite recess 212. Width W may be slightly smaller than the diameter of a gimbal pin. For conventional gimbal pins, width W may be about 0.240 inches, which may require the user to apply a force (i.e. press hard) to elastically deform base 210 such that width w expands to the diameter of gimbal pin to install adjustable shade support 122. Once the gimbal pin in installed and located in the circular cross section having radius r, width W may retract back to its original width, which may lock adjustable shade support 122 in the rod holder. Finally, base 210 may have a length L that is about 2-10 inches, more ideally about 4-8 inches. In one embodiment, length L is six inches. The base 210 that is configured in this way may provide a secure connection to a rod holder for adjustable shade support 122 because the base is not easily retracted from the gimbal pin and because, due the diameter and length of base, base 210 is restricted from bending or tilting within the rod holder. Base 210 may include a recess 212 in which rod 201 is placed to connect rod 201 (i.e. such as using pin 213) to base 210. Recess 212 may be an interference fit, press fit, clearance fit, etc. penetration in base 210 in which rod 201 is placed. Pin 213 may be, for instance, a roll pin that prevents rod 201 from being removed from base 210.

Adjuster 220 may be an adjustable portion of adjustable shade support 122 that provides connector 221 along a length L, or some portion thereof, of rod 201. Adjuster 220 may be vertically and/or rotationally adjustable along length L, or some portion thereof. In the embodiment depicted in FIG. 2, adjuster 220 includes an aperture in which rod 201 may be placed. When aperture includes a circular cross section that is at least the diameter of rod 201 (i.e. when rod is a circular cross section, the diameter of the circular cross section, when rod is, for instance, an octagon cross section, aperture must be at least the diameter of the maximum diameter, or point to point diameter, of rod 201) adjuster 220 may be rotationally connected to rod 201 such that the orientation of connector 221 along rod 201 (and relative to groove 211) may be adjusted. This may allow connector 221 to rotate around rod 201 when, for instance, groove 211 is placed in a gimbal fitting, so that connector can be positioned in the proper orientation to align with a connection point on shade 221. Connector 221 may be installed on adjuster 220 (i.e. formed as a part of, welded on, fastened, pinned, etc.) so that connector 221 may be adjusted along the length L of rod 201, to allow the height of shade 121 to be adjusted by a user. Connector 221 may correspond to a hook, a loop, a snap, a cable connection, or any other type of connection that may be used to connect shade 121 to adjustable shade support 122. The position of connector 221 may be set using retainer 222, which may connect adjuster 220 to rod 201 so that the position of adjuster 220 does not change relative to rod 201 (i.e. due to tension in shade, weight, wind forces, etc.). In the embodiment depicted in FIG. 2, retainer 222 has a threaded portion that corresponds with a threaded portion of adjuster 220 so that a user may tighten retainer 221 against rod 201 by screwing a screw of retainer 222 into adjuster, which screw contacts rod 201 to frictionally set the placement of adjuster 220 along rod (i.e. like a set screw). In other embodiments, rod 201 may include apertures, flats, etc. which retainer 222 may be placed in or on, which may connect adjuster 220 to rod 201 to set the position of connector. A wide variety of retainers may be implemented to set the position of adjuster 220 along rod 201. The use of an adjuster 220 (including a connector and retainer) may be superior to other methods of vertical adjustment along a shaft, such as a telescoping rod, because it may be stronger and/or may more securely hold a connector at a specific location to set the height of a shade without changing position (for instance, when a telescoping rod unintentionally retracts under load, etc.).

Adjuster 220 may be positioned anywhere along length L of adjustable shade support 122 using retainer to secure it in place. The length L of rod may be determined based on the type of boat used in connection with adjustable shade support 122, the height at which a shade is needed, etc. A handle 230 may be provided for the user to hold while using adjustable shade support 122 (i.e. while connecting to a boat, while connecting a shade, while adjusting the height of a shade, etc.). Handle 230 may be formed from a variety of materials and/or may be formed as part of rod 201. In one embodiment, handle 230 corresponds to a rubberized material that is placed on rod 201. In this embodiment, handle 230 includes an inner diameter that is about the same as/slightly smaller than the outer diameter of rod 201 such that handle 230 does not slip along the length L of rod 201 when placed on rod 201. Additionally, or alternatively, handle 230 may include one or more retainers (collars above and below, screws to fasten handle 230 to rod 201, etc.) to maintain handle 230 in place on rod 201. When handle 230 is used, the portion of length L of rod 102 along which adjuster 220 may be placed may be limited based on the location of handle 230. For example, in the embodiment depicted in FIG. 2A, adjuster 220 may be located only above handle 230 (i.e. the length of rod 201 on the opposite side of handle 230 from base 210.) and below stop 240, so length L is limited to this distance. Stop 240 may correspond to an area of increased cross sectional area of rod 201 and/or another component added to rod 201 (i.e. a collar, a screw, etc.) that prevents adjuster 220 from being removed/accidentally sliding off of the second end of rod 201.

The embodiment of adjustable shade support 122 provided in FIG. 2A is for example only, and the systems and methods described herein are not limited to the specific embodiments reflected in the Figures. Adjustable shade supports employing the systems and/or methods described herein may include additional components, fewer components, different components and/or differently arranged components than those described in FIG. 2. Also, in some implementations, one or more of the components depicted in FIG. 2 may perform one or more functions described as being performed by another one or more components of FIG. 2.

The foregoing description provides illustration and description, but is not intended to be exhaustive or to limit the implementations to the precise form disclosed herein. Modifications and variations are possible in light of the above disclosure or may be acquired from practice of the disclosed embodiments. It will be apparent that the systems and/or methods described herein may be implemented in many different forms and in many different ways in addition to those specifically described with reference to FIGS. 1A through 2B. For example, the shade system described herein may be implemented in areas other than on boats, such as recreational vehicles, patios, porches, etc. The actual components and/or materials used to implement the embodiments reflected in FIGS. 1A through 2B are merely example materials and may be used in any alternative environment to provide shade as described herein. It should be understood that the components and/or materials may be designed in any form or fashion to meet the requirements of a particular embodiment.

It should be emphasized that the terms comprises/comprising when used in this specification are taken to specify the presence of stated features, integers, steps or components, but does not preclude the presence or addition of one or more other features, intergers, steps, components or other groups thereof.

What is claimed is:

1. An adjustable shade system for adding a shade to a boat, the adjustable shade system comprising:

a pair of adjustable shade supports, each of the pair of adjustable shade supports comprising, a base configured to be securely installed in the gimbal connection of a rod holder, the base comprising, a groove configured to connect to the gimbal connection of the rod holder, and an outer diameter that is configured to fit within a conventional rod holder, a rod extending from the base, an adjuster having a connector, the adjuster being adjustably connected to the rod to allow the position of the connector to be vertically adjusted along a length of the rod; and a shade connectable to the connectors of the pair of adjustable shade supports and also connectable to a structure of the boat or to an additional adjustable shade support.

2. The adjustable shade system of claim 1, where the groove includes a width at a bottom end of the base, the width being smaller than the diameter of a gimbal pin that is used in a conventional rod holder, the groove being configured to lock the adjustable shade support in the gimbal connection of the rod holder.

3. The adjustable shade support system of claim 1, where the base extends for a length of from about 2 inches to about 10 inches, the base having a uniform cross sectional area along the length.

4. The adjustable shade support system of claim 3, where the length is about six inches.

5. The adjustable shade support system of claim 1, where the outer diameter is from about 1.5 inches to about 1.56 inches.

6. The adjustable shade system of claim 1, where the rod has a diameter that is smaller than the outer diameter of the base.

7. The adjustable shade system of claim 1, where the rod includes a stop.

8. The adjustable shade system of claim 1, where the rod includes a handle.

9. The adjustable shade system of claim 1, where the adjuster further includes a retainer configured to set the position of the adjuster on the rod.

10. The adjustable shade system of claim 1, where the adjuster is configured to rotate around the rod.

11. The adjustable shade system of claim 1, where the base further includes a recess opposite the groove, the rod extending from the recess.

12. The adjustable shade system of claim 1, where the rod includes a cap opposite the base.

13. An adjustable shade support comprising:

a base configured to be securely installed in a rod holder, the base having a groove configured to connect to a gimbal pin of the rod holder, the base having and an outer diameter that is configured to fit within a conventional rod holder, a rod extending from the base, an adjuster that includes a connector, the adjuster being adjustably connected to the rod such that the position of the connector can be adjusted along a length of rod, the connector being connectable to a shade.

14. The adjustable shade support of claim 13, where the groove includes a width at a bottom end of the base and a circular cross section opposite the width, the width being smaller than the diameter of the gimbal pin that is used in a conventional rod holder, the groove being configured to lock the adjustable shade support in the rod holder.

15. The adjustable shade support of claim 14, where the width is about 0.240 inches and the circular cross section has a diameter of about 0.250 inches.

16. The adjustable shade support of claim 13 where the base extends for a length of about six inches.

17. The adjustable shade support of claim 13 where the base has an outer diameter of about 1.53 inches.

18. The adjustable shade support of claim 13 where the rod has a smaller diameter than the base.

19. The adjustable shade support of claim 13 where the base further includes a recess in which the rod is positioned to connect the rod to the base.

20. The adjustable shade support of claim 13, where the adjuster is vertically and rotationally adjustable along the length of the rod and where the length is the distance between a handle and a stop, the base and the stop, or the handle and an end of the rod, the end being on the rod opposite the base.

* * * * *